US008686292B2

(12) United States Patent
Bulmer et al.

(10) Patent No.: US 8,686,292 B2
(45) Date of Patent: Apr. 1, 2014

(54) TUNABLE RESISTANCE CONDUCTIVE INK CIRCUIT

(75) Inventors: Douglas R. Bulmer, Windham, NH (US); Jonathan Roberts, Canaan, NH (US); Davis Murphy, Hudson, NH (US)

(73) Assignee: Miraco, Inc., Manchester, NH (US)

( * ) Notice: Subject to any disclaimer, the term of this patent is extended or adjusted under 35 U.S.C. 154(b) by 30 days.

(21) Appl. No.: 13/402,124

(22) Filed: Feb. 22, 2012

(65) Prior Publication Data

US 2012/0212317 A1 Aug. 23, 2012

Related U.S. Application Data

(60) Provisional application No. 61/445,862, filed on Feb. 23, 2011.

(51) Int. Cl.
*H01B 7/00* (2006.01)

(52) U.S. Cl.
USPC ..... 174/110 R; 174/113 R; 174/117 R; 174/117 F; 174/117 FF

(58) Field of Classification Search
USPC ..... 174/110 R, 117 R, 113 R, 117 F, 117 FF, 174/120 R
See application file for complete search history.

(56) References Cited

U.S. PATENT DOCUMENTS

| | | | | |
|---|---|---|---|---|
| 4,353,372 | A | 10/1982 | Ayer | |
| 4,626,298 | A | 12/1986 | Allard | |
| 6,421,013 | B1 * | 7/2002 | Chung | 343/700 MS |
| 7,388,155 | B2 | 6/2008 | Forbes | |
| 7,399,929 | B2 * | 7/2008 | Ueno et al. | 174/117 FF |
| 7,423,513 | B2 | 9/2008 | Tanaka | |
| 7,812,258 | B2 * | 10/2010 | Price et al. | 174/110 R |
| 2003/0098814 | A1 * | 5/2003 | Keller et al. | 343/742 |
| 2005/0199417 | A1 | 9/2005 | Aisenbrey | |
| 2006/0247509 | A1 * | 11/2006 | Tuccillo et al. | 600/372 |

* cited by examiner

*Primary Examiner* — William H Mayo, III
(74) *Attorney, Agent, or Firm* — Devine Millimet & Branch; Paul C. Remus; Kimberly A.W. Peaslee

(57) ABSTRACT

The method and system of high-resistance, multiple-conductor flat cables which contain integral tunable resistance sections suitable for fine tuning the resistance of a conductor to match the resistance of the conductors to one another within a specified target value. The method involves the design and creation of the high-resistance, multiple-conductor flat cables and the tuning of the resistance of the conductor.

22 Claims, 2 Drawing Sheets

TUNABLE RESISTANCE CONDUCTIVE INK CIRCUIT

CROSS-REFERENCE TO RELATED APPLICATIONS

This application claims the benefit of U.S. Provisional Application No. 61/445,862, filed Feb. 23, 2011.

FIELD OF THE INVENTION

This invention relates to the field of multiple-conductor flat cables. More particularly, this invention relates to tunable, high-resistance, multiple-conductor flat cables.

BACKGROUND OF THE INVENTION

There is a need for high-resistance, multiple-conductor cables for use in Magnetic Resonance Imaging (MRI) procedures to monitor a patient's vital signs. The extreme magnetic fields produced by the MRI machine can interact with the patient monitoring cable producing image artifacts which corrupt the MRI image. Image artifacts can be minimized or eliminated by using a cable with a high enough resistance so that it is not affected by induction currents generated by the magnetic field.

Current manufacturing methods are capable of producing such cables using round wire and wire harness manufacturing techniques but these cable assemblies are relatively expensive to produce. These current techniques also produce cables which contain too much variation in the resistance of the wires within each round wire cable. This invention significantly reduces the manufacturing cost for a high-resistance multiple conductor cable by adapting it to the manufacturing techniques used for producing inexpensive printed thick film (PTF) circuits.

High-resistance conductors can be created by screen printing or other similar coating processes to apply a conductive carbon ink or other conductive polymer to a flat, electrically insulating substrate such as polyester or polyimide film to create a high-resistance PTF circuit, but not with the precision possible with the techniques of the present invention. In this application, there is a need for the conductors of the cable to be closely matched in resistance to one another, generally within +/−5%.

In this application, the cable lengths are typically in excess of six feet and this cannot be consistently achieved with current manufacturing techniques. Standard conductive ink application processes do not provide tight enough control over the conductive ink variables such as thickness, width, density, and the like to produce consistent high-resistance conductors that are matched in resistance to within +/−5%.

For example, with current screen printing methods, the screen needed to produce long cables would be expensive. Another limitation of current screen printing techniques is the ability to lay down multiple layers of ink in order to consistently get the desired thickness. This is in part because each layer needs to be cured before another layer can be applied. The curing process causes shrinkage and variations in the resulting resistance of the conductor. Also, it is difficult to align the previously screened image to subsequent images to create accurate multilayer deposits when printing fine lines. Additionally, the screens have limitations on the size of the mesh available, which also limits the thicknesses of the layers that are possible with current screen printing techniques.

Current printing methods can typically only be used to produce conductors matched in resistance within +/−25% when using the current state of the art practices. Other current printing methods such as pad printing and roll printing also have similar limitations on the ability to control the thickness, width, density, and the like of the conductive ink in order to produce consistent, high-resistance conductors that are matched in resistance within +/−5%.

Existing methods for adjusting the resistance of a printed carbon ink or conductive polymer trace are also limited. The existing methods use a mechanical or abrasive process, such as abrasive media blasting, or laser ablation to remove material to reduce the width and/or increase the length of the conductive path, thereby increasing the resistance. This process can be time consuming, expensive, and inexact. See FIG. 1.

SUMMARY OF THE INVENTION

One aspect of the present invention is a tunable, high-resistance, multiple-conductor flat cable comprising, two or more conductors, and at least one tuning section on at least one conductor for adjusting the resistance of the cable.

In one embodiment of the present invention is the tunable, high-resistance, multiple-conductor flat cable, wherein at least one conductor is a master conductor and is used for matching the resistance of other conductors. In one embodiment of the present invention is the tunable, high-resistance, multiple-conductor flat cable, wherein the master conductor does not contain tuning sections.

In one embodiment of the present invention is the tunable, high-resistance, multiple-conductor flat cable, wherein the number of conductors is from about 4 to about 8.

In one embodiment of the present invention is the tunable, high-resistance, multiple-conductor flat cable, wherein the cable is from about 2 feet to about 10 feet in length.

In one embodiment of the present invention is the tunable, high-resistance, multiple-conductor flat cable, wherein the cable has a resistance from about 8 to about 12 kOhms per foot.

In one embodiment of the present invention is the tunable, high-resistance, multiple-conductor flat cable, wherein the conductor contains more than one tuning section.

In one embodiment of the present invention is the tunable, high-resistance, multiple-conductor flat cable, wherein the tuning section represents from about 0.01 kOhms to about 10 kOhms.

In one embodiment of the present invention is the tunable, high-resistance, multiple-conductor flat cable, wherein the conductor comprises conductive ink that is from about ½ mil to about 5 mil thick.

In one embodiment of the present invention is the tunable, high-resistance, multiple-conductor flat cable, wherein the conductor comprises conductive ink that is from about ½ mil to about 100 mil wide.

In one embodiment of the present invention is the tunable, high-resistance, multiple-conductor flat cable, wherein the tuning section comprises one or more conductive loops with multiple conductive paths.

Another aspect of the present invention is a method of tuning a high-resistance, multiple-conductor flat cable comprising, providing a cable, wherein the cable has two or more conductors with at least one tuning section on at least one conductor; and severing at least one tuning section, thereby increasing the resistance of the cable.

In one embodiment of the present invention is the method of tuning a high-resistance, multiple-conductor flat cable, wherein at least one conductor is a master conductor and is used for matching the resistance of other conductors. In one embodiment of the present invention is the method of tuning a high-resistance, multiple-conductor flat cable, wherein the master conductor does not contain tuning sections.

In one embodiment of the present invention is the method of tuning a high-resistance, multiple-conductor flat cable, wherein the number of conductors is from about 4 to about 8.

In one embodiment of the present invention is the method of tuning a high-resistance, multiple-conductor flat cable, wherein the cable is from about 2 feet to about 10 feet in length.

In one embodiment of the present invention is the method of tuning a high-resistance, multiple-conductor flat cable, wherein the cable has a resistance from about 8 to about 12 kOhms per foot.

In one embodiment of the present invention is the method of tuning a high-resistance, multiple-conductor flat cable, wherein the conductor contains more than one tuning section.

In one embodiment of the present invention is the method of tuning a high-resistance, multiple-conductor flat cable, wherein the tuning section represents from about 0.01 to about 10 kOhms.

In one embodiment of the present invention is the method of tuning a high-resistance, multiple-conductor flat cable, wherein the conductor comprises conductive ink that is from about ½ mil to about 5 mil thick.

In one embodiment of the present invention is the method of tuning a high-resistance, multiple-conductor flat cable, wherein the conductor is from about ½ mil to about 100 mil wide.

In one embodiment of the present invention is the method of tuning a high-resistance, multiple-conductor flat cable, wherein the step of severing comprises punching, drilling, cutting, skiving, scoring, or ablating with a laser.

In one embodiment of the present invention is the method of tuning a high-resistance, multiple-conductor flat cable, wherein the step of severing occurs after an insulating film has been applied to the conductor.

Another aspect of the present invention is a method of manufacturing a tunable, high-resistance, multiple-conductor flat cable, comprising, providing a substrate, wherein the substrate contains a negative image of the conductor pattern; applying conductive ink to the conductor pattern, thereby forming a conductor; curing the conductive ink; stripping the substrate, thereby leaving the conductor; and laminating the conductor, thereby forming a tunable, high-resistance, multiple-conductor flat cable.

In one embodiment of the present invention is the method of manufacturing a tunable, high-resistance, multiple-conductor flat cable, wherein the substrate is dry film photoresist.

In one embodiment of the present invention is the method of manufacturing a tunable, high-resistance, multiple-conductor flat cable, wherein the conductor pattern comprises two or more conductors, and at least one tuning section on at least one conductor.

In one embodiment of the present invention is the method of manufacturing a tunable, high-resistance, multiple-conductor flat cable, wherein The tuning section comprises one or more closed conductive loops with multiple conductive paths.

In one embodiment of the present invention is the method of manufacturing a tunable, high-resistance, multiple-conductor flat cable, wherein the step of applying conductive ink is repeated.

In one embodiment of the present invention is the method of manufacturing a tunable, high-resistance, multiple-conductor flat cable, wherein the step of curing the ink comprises heating the ink in an oven.

In one embodiment of the present invention is the method of manufacturing a tunable, high-resistance, multiple-conductor flat cable, further comprising the step of measuring the resistance of the conductor.

In one embodiment of the present invention is the method of manufacturing a tunable, high-resistance, multiple-conductor flat cable, wherein the step of measuring the resistance of the conductor occurs after the lamination step.

These aspects of the invention are not meant to be exclusive and other features, aspects, and advantages of the present invention will be readily apparent to those of ordinary skill in the art when read in conjunction with the following description, appended claims, and accompanying drawings.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
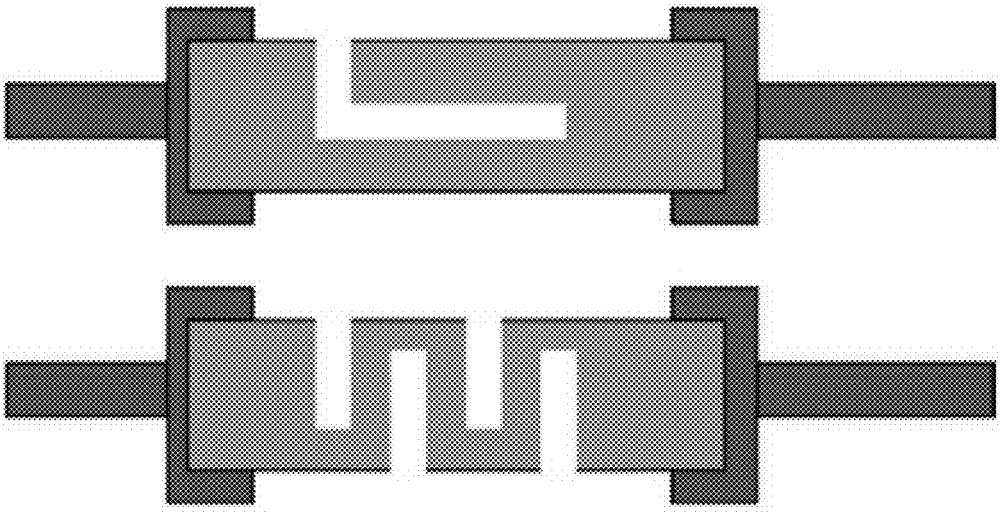
Prior art Figure 1
FIG. 1 is a schematic representation of prior art systems.
Figure 2:
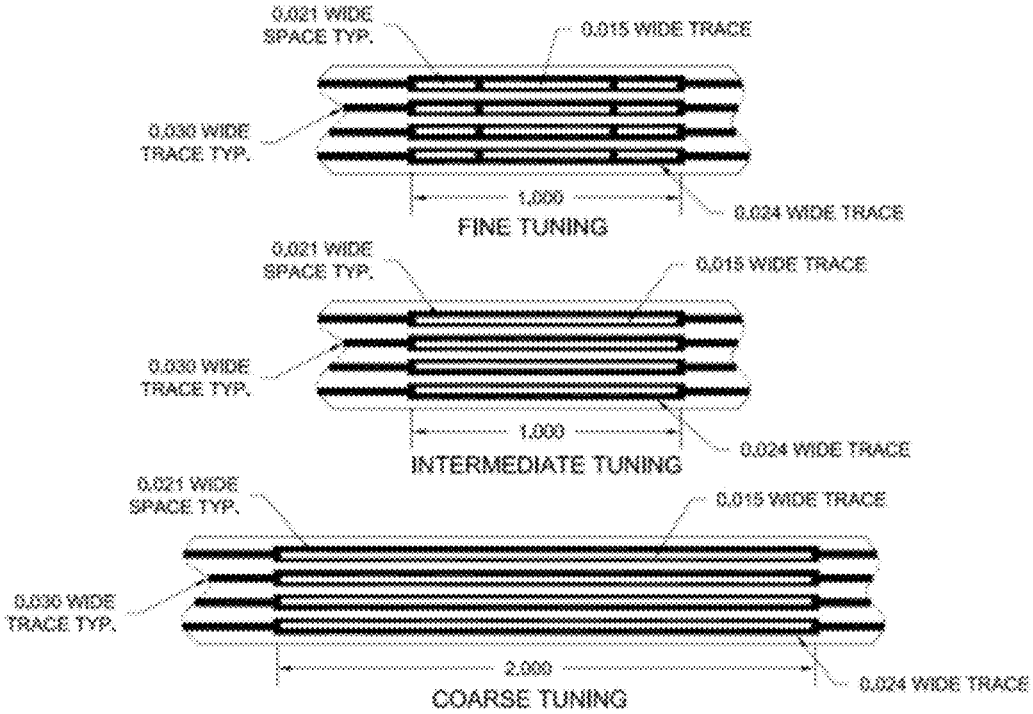
FIG. 2 is a schematic representation of some embodiments of the present invention.

This invention solves the previously stated problems by adding multiple "tuning" sections made up of one or more closed conductive loops with multiple conductive paths on each conductor which can be easily and inexpensively severed to adjust the individual conductor resistances after the application of the conductive ink to the substrate. By varying the length of the tuning sections by design, it is possible to provide different degrees of adjustment from coarse adjustment to fine adjustment. See FIG. 2 for some embodiments of the present invention.

One application of the method and system of high-resistance, multiple-conductor flat cables of the present invention is for use in monitoring a patient while the patient is in or near a MRI machine: The range of resistance needed to overcome inductive interference caused by the MRI machine is from about 50 kOhms to about 70 kOhms for a 6 foot cable. Generally, the resistance is from about 8 kOhms to about 12 kOhms per foot of cable. It is important for the cables to be within the recommended resistance range, but it is also important that the conductors within the cable be consistent, to within +/−5% of each other, to minimize the amount of calibration needed when used in conjunction with the patient monitoring devices.

Adjustments are made to the conductor's resistance by severing one or more of the conductive paths depending on the design. This operation can be performed before or after a protective insulating cover film is applied over the conductor. In some cases the severing is best done after the insulating film has been applied to the ink since the laminating step can alter the resistance of the conductive paths. The severing operation can be performed by mechanical means including punching, drilling, cutting, scoring, skiving and the like, which can be performed manually or mechanically with inexpensive tooling, or by non-mechanical means such as laser ablation.

The severing of one of the conductive paths produces predictable results and requires only a single operation to adjust the overall resistance of the conductor by a predetermined amount. The predictability of the change in resistance lends itself well to automated processes. The high-resistance, multiple-conductor flat cable is designed and manufactured with a sufficient number of tuning sections to provide sufficient adjustability to compensate for the expected resistance variations due to manufacturing tolerances. Tuning sections can be located close to each other (e.g. about every few inches or so) or rather far from each other (e.g. about every foot or so) depending on the desired application. Tuning sections can vary in length from several inches to less than an inch in length. This allows for a wide range of tunability for the cable; from "coarse" to "fine" adjustments, depending on the desired application.

The method and system of the present invention can be used to produce cables with multiple conductors, where the term multiple represents up to about 50. More preferably, the number of conductors will be less than about 10. Any high-resistance, conductive ink known to those of ordinary skill in the art would be useful in this invention. Many conductive inks contain conductive materials such as powdered or flaked silver and carbon like materials. Some potentially useful inks include, silver tilled epoxy, conductive carbon ink, silver plated copper epoxy ink, silver plated glass epoxy ink, PTF (polymer thick film) ink, and generally any type of conductive, high resistance ink. The substrates can include many materials, such as polyester (Mylar™), polyimide (Kapton™), paper (Nomex™), and the like. The electrical grade films used in the present invention are generally electrically insulating, and could be rubber-like polymers and most plastics. Such materials can serve as practical and safe insulators for low to moderate voltages (hundreds, or even thousands, of volts).

After the cable is manufactured, the resistance of each parallel conductor is measured to determine the value of the conductor with the highest resistance. The lower resistance conductors are each adjusted by severing one or more of the conductive paths of the appropriate tuning sections to systematically increase the overall resistance of the conductor until all conductor resistances are within the specified tolerance. Also, the total resistance of each conductor can be increased in the same manner to meet a specified minimum resistance requirement.

Experimental:

Dry Film Photoresist Lamination: The process begins by laminating dry film photoresist (2 layers of 0.0.015" thick was used) to one side of each sheet of polyester (Mylar™). The polyester sheets were 24"×78"×0.005" thick. Surface preparation was performed prior to dry film photoresist lamination to increase ink adhesion. The polyester sheet was heat stabilized to prevent shrinkage during the manufacturing process, particularly during ink curing and coverfilm lamination. Next, the image and the negative image of the conductor pattern was developed in the dry film photoresist. Each sheet was slit into two 12" wide strips for easier handling & processing.

Carbon Ink Application: The conductive ink was mixed (CMI 112-48 Conductive Ink was thinned with #112-19 thinner at an approximate ratio of 10 parts ink to 1 part thinner, just enough for the ink to run freely off a mixing stick). Each 12"×78" strip was layed flat on an 8' long table to apply ink across the entire sheet by dragging the ink with a plastic putty knife with a ground edge (acting as a squeegee). The knife was held at approximately a 60 degree angle from the panel surface with approximately a 15 degree plow angle. The knife was dragged at approximately 45 inches per minute and each part received a single pass alternating from left to right or right to left for each of 2 consecutive parts.

After applying the ink, each sheet was placed in an oven (at 50° C. to 60° C. for CMI 112-48 conductive ink). The ink was cured on each sheet in the oven for (20-30 minutes for this ink). After curing the first coat of carbon ink, a second coat of ink was applied using the same process. After curing the second coat, the ink was dried overnight and then the test coupons and parts were measured in several places. There was typically a 20% decrease in the resistance due to the lamination process so the parts needed to measure from about 60 kOhms to about 84 kOhms at this stage to be used in this application. If the resistance measured above the maximum value, then a third coat of carbon ink was applied.

If needed, the third coat of ink was applied using the same application and curing process as mentioned above. The ink was dried overnight and then the test coupons and parts were measured in several places. Next, the stripping step chemically removed the dry film photoresist. The measurement and recording of the resistance of all of the parts was conducted with a high resistance test meter. Traces on each part were typically within +/−5% of one another at this point. See Table 1.

The coverfilm lamination step was next. Pre-cut polyester coverall (0.001"×24" wide thick Sheldahl T1929 polyester coverfilm) was cut into 70"×12" strips. Each panel was taped down to a table and tacky rolled to remove dust and fibers prior to tacking the polyester coverall. Also, each of the polyester strips was tacky rolled. Each strip of coverfilm was aligned to the panel with one end aligned to the hash marks and then taped in place using plater's tape in several locations. The overhanging end of the coverfilm was trimmed by sliding a piece of polyester under it and then using a steel ruler aligned to the hash marks and an X-Acto™ knife was used to accurately trim the excess. The coverfilm strips were tacked in place at 6 locations using a tacking iron. The coverfilm was laminated in a hydraulic lamination press. There was up to a 40% decrease in resistance due to the lamination process.

Silver application: the silver ink was optionally applied at the contact ends of the part to increase conductivity where crimped contacts were applied. The parts were outlined on a laser or steel rule die. The resistance tuning consisted of measuring each part and tuning to adjust the resistance of all the traces so they were within +/−1% of each other and within the 50 kOhm minimum and the 70 kOhm maximum range by punching or drilling holes through the tuning sections.

TABLE 1

| | Resistance Prior to Lamination (kOhms) | Resistance After Lamination (kOhms) | Resistance After Adjustment (kOhms) |
|---|---|---|---|
| Cable 1 | 81.89 | 48.23 | 50.66 |
| | 82.73 | 48.13 | 50.54 |
| | 83.77 | 48.60 | 50.56 |
| | 84.79 | 50.80 | 50.51 |
| Deviation | 1.04 | 1.06 | 1.00 |
| Cable 2 | 82.52 | 48.25 | 50.37 |
| | 82.67 | 47.81 | 50.35 |
| | 83.24 | 48.26 | 50.37 |
| | 83.71 | 49.64 | 50.38 |
| Deviation | 1.01 | 1.04 | 1.00 |
| Cable 3 | 84.38 | 49.37 | 50.40 |
| | 80.80 | 47.48 | 50.40 |
| | 80.31 | 47.27 | 50.48 |
| | 80.42 | 48.44 | 50.51 |
| Deviation | 1.05 | 1.04 | 1.00 |
| Cable 4 | 72.54 | 45.76 | 50.01 |
| | 79.26 | 50.60 | 50.60 |
| | 78.45 | 50.58 | 50.58 |
| | 76.20 | 50.55 | 50.55 |

TABLE 1-continued

| | Resistance Prior to Lamination (kOhms) | Resistance After Lamination (kOhms) | Resistance After Adjustment (kOhms) |
|---|---|---|---|
| Deviation | 1.09 | 1.11 | 1.01 |
| Cable 5 | 81.48 | 49.59 | 52.27 |
| | 80.00 | 47.86 | 52.20 |
| | 79.77 | 47.62 | 52.25 |
| | 79.43 | 48.01 | 52.22 |
| Deviation | 1.03 | 1.04 | 1.00 |

The tuning parameters used in some embodiments included the following ranges for various tuning sections labeled full, half, quarter and eight for these embodiments, where the narrow trace has a higher resistance than the wider trace due to less conductive material. Trimming the wide trace will result in a larger net resistance increase for the main trace (because current is now flowing through the higher resistance trace) and vice versa for the narrow trace thereby allowing for two different resistance adjustments in the same tuning section.

| | |
|---|---|
| Full Tuning Section - Wide Trace | ~2.00-2.50 kOhm |
| Full Tuning Section - Narrow Trace | ~0.75-1.00 kOhm |
| Half Tuning Section - Wide Trace | ~1.00 kOhm |
| Half Tuning Section - Narrow Trace | ~0.50 kOhm |
| Quarter Tuning Section - Wide Trace | ~0.50 kOhm |
| Quarter Tuning Section - Narrow Trace | ~0.25 kOhm |
| Eighth Tuning Section - Wide Trace | ~0.20 kOhm |
| Eighth Tuning Section - Narrow Trace | ~0.05 kOhm |
| Maximum Adjustment per Part | ~18 kOhm |

In one embodiment, the number of conductors is from about 2 to about 50. In one embodiment, the number of conductors is from about 2 to about 25. In one embodiment, the number of conductors is from about 2 to about 10. In one embodiment, the number of conductors is from about 4 to about 8. In one embodiment, the number of conductors is about 2, about 3, about 4, about 5, about 6, about 7, about 8, or about 9. In one embodiment, the number of conductors is about 10, about 11, about 12, about 13, about 14, about 15, about 16, about 17, about 18, or about 19. In one embodiment, the number of conductors is about 20; about 21, about 22, about 23, about 24, about 25, about 26, about 27, about 28, or about 29. In one embodiment, the number of conductors is about 30, about 31, about 32, about 33, about 34, about 35, about 36, about 37, about 38, or about 39. In one embodiment, the number of conductors is about 40, about 41, about 42, about 43, about 44, about 45, about 46, about 47, about 48, about 49, or about 50.

In one embodiment, the width of the conductive ink is from about ½ mil to about 100 mil wide. In one embodiment, the width of the conductive ink is from about ½ mil to about 50 mil wide. In one embodiment, the width of the conductive ink is from about ½ to about 25 mil wide. In one embodiment, the width of the conductive ink is from about ½ mil to about 10 mil wide. In one embodiment, the width of the conductive ink is from about ½ to about 5 mil wide. In one embodiment, the width of the conductive ink is from about ½ mil to about 2 mil wide. In one embodiment, the width of the conductive ink is about ½ mil, about 1 mil, about 1½ mil, about 2 mil, about 2½ mil, about 3 mil, about 3½ mil, about 4 mil, about 4½ mil, about 5 mil, about 5½ mil, about 6 mil, about 6½ mil, about 7 mil, about 7½ mil, about 8 mil, about 8½ mil, about 9 mil, or about 9½ mil. In one embodiment, the width of the conductive ink is about 10 mil, about 11 mil, about 12 mil, about 13 mil, about 14 mil, about 15 mil, about 16 mil, about 17 mil, about 18 mil, about 19 mil, about 20 mil, about 21 mil, about 22 mil, about 23 mil, about 24 mil, about 25 mil, about 26 mil, about 27 mil, about 28 mil or about 29 mil. In one embodiment, the width of the conductive ink is about 30 mil, about 31 mil, about 32 mil, about 33 mil, about 34 mil, about 35 mil, about 36 mil, about 37 mil, about 38 mil, about 39 mil, about 40 mil, about 41 mil, about 42 mil, about 43 mil, about 44 mil, about 45 mil, about 46 mil, about 47 mil, about 48 mil or about 49 mil. In one embodiment, the width of the conductive ink is about 50 mil, about 51 mil, about 52 mil, about 53 mil, about 54 mil, about 55 mil, about 56 mil, about 57 mil, about 58 mil, about 59 mil, about 60 mil, about 61 mil, about 62 mil, about 63 mil, about 64 mil, about 65 mil, about 66 mil, about 67 mil, about 68 mil or about 69 mil. In one embodiment, the width of the conductive ink is about 70 mil, about 71 mil, about 72 mil, about 73 mil, about 74 mil, about 75 mil, about 76 mil, about 77 mil, about 78 mil, about 79 mil, about 80 mil, about 81 mil, about 82 mil, about 83 mil, about 84 mil, about 85 mil, about 86 mil, about 87 mil, about 88 mil or about 89 mil. In one embodiment, the width of the conductive ink is about 90 mil, about 91 mil, about 92 mil, about 93 mil, about 94 mil, about 95 mil, about 96 Mil, about 97 mil, about 98 mil, about 99 mil, or about 100 mil.

In one embodiment, the thickness of the conductive ink is from about ½ mil to about 5 mil wide. In one embodiment, the thickness of the conductive ink is from about ½ mil to about 4 mil wide. In one embodiment, the thickness of the conductive ink is from about ½ mil to about 3 mil wide. In one embodiment, the thickness of the conductive ink is from about ½ mil to about 2 mil wide. In one embodiment, the thickness of the conductive ink is from about ½ mil to about 1 mil wide. In one embodiment, the thickness of the conductive ink is about ½ mil, about 1 mil, about 1½ mil, about 2 mil, about 2½ mil, about 3 mil, about 3½ mil, about 4 mil, about 4½ mil, or about 5 mil.

In one embodiment, the length of each tuning section is about ¼ inch to about 12 inches. In one embodiment, the length of each tuning section is about ¼ inch to about 10 inches. In one embodiment, the length of each tuning section is about ¼ inches to about 8 inches. In one embodiment, the length of each tuning section is about ¼ inch, about ½ inch, about ¾ inch, or about 1 inch. In one embodiment, the length of each tuning section is about 1½ inches, about 2 inches, about 2½ inches, about 3 inches, about 3½ inches, about 4 inches, about 4½ inches or about 5 inches. In one embodiment, the length of each tuning section is about 5½ inches, about 6 inches, about 6½ inches, about 7 inches, about 7½ inches, about 8 inches, about 8½ inches, about 9 inches, about 9½ inches, about 10 inches, about 10½ inches, about 11 inches, about 11½ inches, or about 12 inches.

In one embodiment the tuning section represents from about 0.02 kOhms to about 10 kOhms. In one embodiment the tuning section represents from about 0.02 kOhms to about 5 kOhms. In one embodiment the tuning section represents from about 0.02 kOhms to about 2.5 kOhms. In one embodiment the tuning section represents from about 0.02 kOhms to about 2 kOhms. In one embodiment the tuning section represents from about 0.02 kOhms to about 1 kOhms. In one embodiment the tuning section represents from about 0.02 kOhms to about 0.5 kOhms. In one embodiment the tuning section represents from about 0.02 kOhms to about 0.25 kOhms. In one embodiment, the tuning section represents about 0.02 kOhms, about 0.03 kOhms, about 0.04 kOhms, about 0.05 kOhms, about 0.06 kOhms, about 0.07 kOhms, about 0.08 kOhms, about 0.09 kOhms, or about 0.1 kOhms. In one embodiment, the tuning section represents about 0.11 kOhms, about 0.12 kOhms, about 0.13 kOhms, about 0.14 kOhms, about 0.15 kOhms, about 0.16 kOhms, about 0.17 kOhms, about 0.18 kOhms, about 0.19 kOhms, or about 0.20 kOhms in one embodiment, the tuning section represents about 0.21 kOhms, about 0.22 kOhms, about 0.23 kOhms, about 0.24 kOhms, about 0.25 kOhms, about 0.26 kOhms, about 0.27 kOhms, about 0.28 kOhms, about 0.29 kOhms, or about 0.30 kOhms. In one embodiment, the tuning section represents about 0.31 kOhms, about 0.32 kOhms, about 0.33 kOhms, about 0.34 kOhms, about 0.35 kOhms, about 0.36 kOhms, about 0.37 kOhms, about 0.38 kOhms, about 0.39 kOhms, or about 0.40 kOhms. In one embodiment, the tuning section represents about 0.41 kOhms, about 0.42 kOhms, about 0.43 kOhms, about 0.44 kOhms, about 0.45 kOhms, about 0.46 kOhms, about 0.47 kOhms, about 0.48 kOhms, about 0.49 kOhms, or about 0.50 kOhms. In one embodiment, the tuning section represents about 0.51 kOhms, about 0.52 kOhms, about 0.53 kOhms, about 0.54 kOhms, about 0.55 kOhms, about 0.56 kOhms, about 0.57 kOhms, about 0.58 kOhms, about 0.59 kOhms, or about 0.60 kOhms. In one embodiment, the tuning section represents about 0.61 kOhms, about 0.62 kOhms, about 0.63 kOhms, about 0.64 kOhms, about 0.65 kOhms, about 0.66 kOhms, about 0.67 kOhms, about 0.68 kOhms, about 0.69 kOhms, or about 0.70 kOhms. In one embodiment, the tuning section represents about 0.71 kOhms, about 0.72 kOhms, about 0.73 kOhms, about 0.74 kOhms, about 0.75 kOhms, about 0.76 kOhms, about 0.77 kOhms, about 0.78 kOhms, about 0.79 kOhms, or about 0.80 kOhms. In one embodiment, the tuning section represents about 0.81 kOhms, about 0.82 kOhms, about 0.83 kOhms, about 0.84 kOhms, about 0.85 kOhms, about 0.86 kOhms, about 0.87 kOhms, about 0.88 kOhms, about 0.89 kOhms, or about 0.90 kOhms. In one embodiment, the tuning section represents about 0.91 kOhms, about 0.92 kOhms, about 0.93 kOhms, about 0.94 kOhms, about 0.95 kOhms, about 0.96 kOhms, about 0.97 kOhms, about 0.98 kOhms, about 0.99 kOhms, or about 1 kOhm. In one embodiment, the tuning section represents about 1.1 kOhms, about 1.2 kOhms, about 1.3 kOhms, about 1.4 kOhms, about 1.5 kOhms, about 1.6 kOhms, about 1.7 kOhms, about 1.8 kOhms, or about 1.9 kOhms. In one embodiment, the tuning section represents about 2 kOhms, about 2.1 kOhms, about 2.2 kOhms, about 2.3 kOhms, about 2.4 kOhms, about 2.5 kOhms, about 2.6 kOhms, about 2.7 kOhms, about 2.8 kOhms, about 2.9 kOhms, or about 3 kOhms. In one embodiment, the tuning section represents about 3.1 kOhms, about 3.2 kOhms, about 3.3 kOhms, about 3.4 kOhms, about 3.5 kOhms, about 3.6 kOhms, about 3.7 kOhms, about 3.8 kOhms, or about 3.9 kOhms. In one embodiment, the tuning section represents about 4 kOhms, about 4.1 kOhms, about 4.2 kOhms, about 4.3 kOhms, about 4.4 kOhms, about 4.5 kOhms, about 4.6 kOhms, about 4.7 kOhms, about 4.8 kOhms, or about 4.9 kOhms. In one embodiment, the tuning section represents about 5 kOhms, about 5.1 kOhms, about 5.2 kOhms, about 5.3 kOhms, about 5.4 kOhms, about 5.5 kOhms, about 5.6 kOhms, about 5.7 kOhms, about 5.8 kOhms, or about 5.9 kOhms. In one embodiment, the tuning section represents about 6 kOhms, about 6.1 kOhms, about 6.2 kOhms, about 6.3 kOhms, about 6.4 kOhms, about 6.5 kOhms, about 6.6 kOhms, about 6.7 kOhms, about 6.8 kOhms, or about 6.9 kOhms. In one embodiment, the tuning section represents about 7 kOhms, about 7.1 kOhms, about 7.2 kOhms, about 7.3 kOhms, about 7.4 kOhms, about 7.5 kOhms, about 7.6 kOhms, about 7.7 kOhms, about 7.8 kOhms, or about 7.9 kOhms. In one embodiment, the tuning section represents about 8 kOhms, about 8.1 kOhms, about 8.2 kOhms, about 8.3 kOhms, about 8.4 kOhms, about 8.5 kOhms, about 8.6 kOhms, about 8.7 kOhms, about 8.8 kOhms, or about 8.9 kOhms. In one embodiment, the tuning section represents about 9 kOhms, about 9.1 kOhms, about 9.2 kOhms, about 9.3 kOhms, about 9.4 kOhms, about 9.5 kOhms, about 9.6 kOhms, about 9.7 kOhms, about 9.8 kOhms, about 9.9 kOhms or about 10 kOhms.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed:

1. A tunable, high-resistance, multiple-conductor flat cable comprising, two more conductors wherein at least one conductor is a master conductor and is used for matching the resistance of other conductors, and at least one tuning section on at least one conductor for adjusting the resistance of the flat cable wherein the cable has a resistance from about 8 to about 12 kOhms per foot and the tuning section represents from about 0.02 kOhms to about 10 kOhms.

2. The tunable, high-resistance, multiple-conductor flat cable of claim 1, wherein the master conductor does not contain tuning sections.

3. The tunable, high-resistance, multiple-conductor flat cable of claim 1, wherein the number of conductors is from about 4 to about 8.

4. The tunable, high-resistance, multiple-conductor flat cable of claim 1, wherein the cable is from about 2 feet to about 10 feet in length.

5. The tunable, high-resistance, multiple-conductor flat cable of claim 1, wherein the conductor contains more than one tuning section.

6. The tunable, high-resistance, multiple-conductor flat cable of claim 1, wherein the conductor comprises conductive ink that is from about ½ mil to about 5 mil thick and from about ½ mil to about 100 mil wide.

7. The tunable, high-resistance, multiple-conductor flat cable of claim 1, wherein the tuning section comprises one or more conductive loops with multiple conductive paths.

8. A method of tuning a high-resistance, multi e-conductor flat cable comprising, providing a cable, wherein the cable has two or more conductors with at least one tuning section on at least one conductor, wherein at least one conductor is a master conductor and is used for matching the resistance of other conductors; and severing at least one tuning section, thereby increasing the resistance of the flat cable, wherein the cable has a resistance from about 8 to about 12 kOhms per foot and the tuning section represents from about 0.02 to about 10 kOhms.

9. The method of tuning a high-resistance, multiple-conductor flat cable of claim 8, wherein the master conductor does not contain tuning sections.

10. The method awning a high-resistance, multiple-conductor flat cable of claim 8, wherein the number of conductors is from about 4 to about 8.

11. The method of tuning a high-resistance, multiple-conductor flat cable of claim 8, wherein the cable is from about 2 feet to about 10 feet in length.

12. The method of tuning high-resistance, multiple-conductor flat cable of claim 8, wherein the conductor contains more than one tuning section.

13. The method of tuning a high-resistance, multiple-conductor flat cable of claim 8, wherein the conductor comprises conductive ink that is from about ½ mil to about 5 mil thick and from about ½ nil to about 100 mil wide.

14. The method of tuning a high-resistance, multiple-conductor flat cable or claim 8, wherein the step of severing comprises punching, drilling, cutting, skiving, scoring, or ablating with a laser.

15. The method of tuning a high-resistance, multiple-conductor flat cable of claim 8, wherein the step of severing occurs after an insulating film has been applied to the conductor.

16. A method of manufacturing a tunable, high-resistance, multiple-conductor flat cable, comprising, providing a substrate, wherein the substrate contains a negative image of the conductor pattern, wherein the conductor pattern comprises two or more conductors, and at least one tuning section on at least one conductor, wherein at least one conductor is a master conductor and is used for matching the resistance of other conductors;

applying conductive ink to the conductor pattern, thereby forming a conductor;

curing the conductive ink;

stripping the substrate, thereby leaving the conductor; and laminating the conductor, thereby forming a tunable, high-resistance, multiple-conductor flat cable, wherein the cable has a resistance from about 8 to about 12 kOhms per foot and the tuning section represents from about (0.02 to about 10 kOhms.

17. The method of manufacturing a tunable, high-resistance, multiple-conductor flat cable of claim 16, wherein the substrate is dry film photoresist.

18. The method of manufacturing a tunable, high-resistance, conductor flat cable of claim 16, wherein the tuning section comprises one or more closed conductive loops with multiple conductive paths.

19. The method of manufacturing a tunable, high-resistance, multiple-conductor flat cable of claim 16, wherein the step of applying conductive ink is repeated.

20. The method manufacturing a tunable, high-resistance, multiple-conductor flat cable of claim 16, wherein the step of curing the ink comprises heating the ink in an oven.

21. The method of manufacturing a tunable, high-resistance, multiple-conductor flat cable of claim 16, further comprising the step of measuring the resistance of the conductor.

22. The method manufacturing a tunable, high-resistance, multiple-conductor flat cable of claim 21, wherein the step of measuring the resistance of the conductor occurs after the lamination step.

* * * * *